US005194880A

United States Patent [19]

Elrod et al.

[11] Patent Number: 5,194,880

[45] Date of Patent: Mar. 16, 1993

[54] MULTI-ELECTRODE, FOCUSED CAPILLARY WAVE ENERGY GENERATOR

[75] Inventors: Scott A. Elrod; Butrus T. Khuri-Yakub, both of Palo Alto; Calvin F. Quate, Stanford, all of Calif.

[73] Assignee: Xerox Corporation, Stamford, Conn.

[21] Appl. No.: 632,260

[22] Filed: Dec. 21, 1990

[51] Int. Cl.[5] ..... B41J 21/04

[52] U.S. Cl. ..... 346/140 R; 310/366

[58] Field of Search ..... 346/140 R; 310/334, 310/366, 800; 118/300, 313, 624–625; 239/102.2

[56] References Cited

U.S. PATENT DOCUMENTS

| | | | |
|---|---|---|---|
| 4,282,532 | 8/1981 | Markham | 346/75 |
| 4,383,265 | 5/1983 | Kohashi | 346/140 R |
| 4,697,195 | 9/1987 | Quate et al. | 346/140 R |
| 4,719,476 | 1/1988 | Elrod et al. | 346/140 R |
| 4,719,480 | 1/1988 | Elrod et al. | 346/140 R |
| 4,748,461 | 5/1988 | Elrod | 346/140 R |

*Primary Examiner*—Benjamin R. Fuller
*Assistant Examiner*—N. Lee
*Attorney, Agent, or Firm*—Townsend and Townsend

[57] ABSTRACT

An ejector for ejecting droplets from an ink-filled reservoir is disclosed. The ejector comprises a substrate with a generally planar surface. The substrate is submerged in the reservoir so that the substrate surface is parallel to the reservoir surface at a shallow predetermined depth. On the substrate surface around a center is a plurality of concentric, circular electrodes. A coupled oscillator excites the electrodes in a temporal relationship such that the capillary waves generated at the ink reservoir surface are reinforced so that droplets may be ejected from the reservoir at the center of the electrodes.

11 Claims, 1 Drawing Sheet

MULTI-ELECTRODE, FOCUSED CAPILLARY WAVE ENERGY GENERATOR

BACKGROUND OF THE INVENTION

The present invention is related to ink jet printing and, in particular, to ejectors used in generating ink droplets for such printing.

Various types of ejectors have been developed for the printheads of ink jet printers. There are "continuous stream" and "drop on demand" ejectors with nozzles having small ejection orifices for defining the size of the ejected liquid ink droplets. These suffer from many disadvantages, such as maintenance requirements due to clogged nozzles and high manufacturing costs due to the nozzles. Other kinds of ink jet printers are acoustic ink printers in which the droplets are emitted from the surface of ink reservoirs.

As the name implies, in acoustic ink printing acoustic waves are used to drive droplets from the free surface of the ink onto a recording medium. One type of acoustic ink ejector is discussed in U.S. Pat. No. 4,751,529, issued on Jan. 14, 1988 to the present inventors and another, and assigned to the present assignee. In that patent, a concave surface in the surface of a substrate is used as a lens to focus the acoustic waves at the free surface of the ink reservoir.

Another type of acoustic ink ejector is discussed in U.S. Pat. No. 4,697,195, issued to C. F. Quate et al. on Sep. 29, 1987 and also assigned to the present assignee. In that patent, surface acoustic waves are generated by interdigitated electrodes on a piezoelectric substrate. Since the electrodes are arranged concentrically in a circle, these waves form a converging cone of acoustic waves focused at the free surface of the liquid. The waves subsequently leak into an ink bath above them.

A variation of the acoustic ink ejector is found in U.S. Pat. No. 4,748,461, issued on May 31, 1988 to Scott A. Elrod, one of the inventors of the present application, and assigned to the present assignee. In that patent, focused acoustic waves are generated by transducers below the surface of a liquid-filled reservoir. The acoustic waves come to a focus at or near the surface of the liquid. The action of the transducers is modulated by a pair of circular electrodes which generate capillary waves on the liquid surface. The electrode pair can act as a switch to turn the ejection action of the acoustic waves on or off, or to control the angular trajectory of the ejected droplets.

The present invention presents a way of using capillary waves themselves to eject liquid droplets from the surface of a liquid reservoir without the use of nozzles.

SUMMARY OF THE INVENTION

The present invention provides for an ejector for ejecting droplets from an liquid-filled reservoir. The ejector comprises a substrate with a generally planar surface. The substrate is submerged in the reservoir so that the substrate surface is parallel to the reservoir surface at a shallow predetermined depth. On the substrate surface around a center is a plurality of concentric, circular electrodes. A coupled oscillator excites the electrodes in a temporal relationship such that the capillary waves generated at the ink reservoir surface are reinforced to cause droplets to be ejected from the reservoir at the center of the electrodes.

By setting the width of electrodes equal to the distance separating the electrodes, the oscillator can most efficiently eject the droplets at a frequency $$f=V_{capillary}/2W$$

where $V_{capillary}$ is the velocity of the capillary waves generated at the reservoir surface by the excited electrodes and W is the width and separation distance of the electrodes.

BRIEF DESCRIPTION OF THE DRAWINGS

A detailed understanding of the present invention may be attained by a review of the following Description of the Specific Embodiments with reference to the drawings below.

DESCRIPTION OF THE SPECIFIC EMBODIMENT(S)

Figure 1:
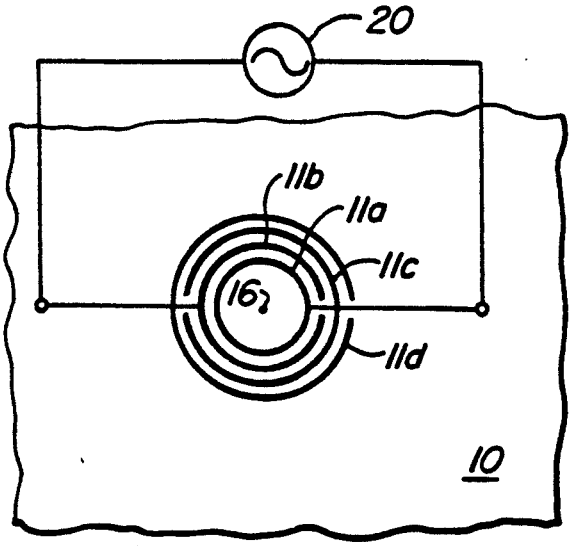
FIG. 1 is a top view of a wave droplet ejector according to the present invention.
Figure 2:
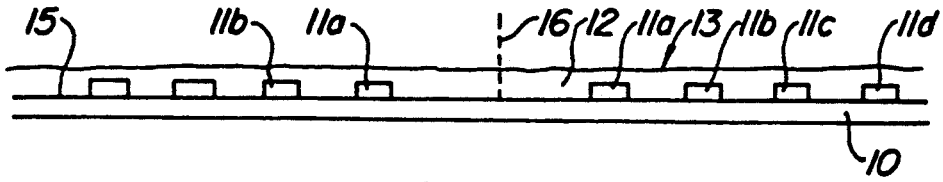
FIG. 2 is a side view of FIG. 1.

FIG. 1 and FIG. 2 are respectively a top view and a side view of the wave droplet ejector according to the present invention.

The present invention provides for a substrate with a flat, planar surface 15. The substrate 10 is made from electrically nonconducting material, such as glass or plastic. On the surface 15 a plurality of circularly concentric, metal electrodes 11*a*–11*d* are formed about a central axis 16. It is desirable that the electrodes 11*a*–11*d* be coated with a protective layer of material to avoid electrochemical reactions between the electrodes and ink.

The electrodes 11*a*–11*d* are connected to a power source, an oscillator circuit 20, which drives the electrodes at a predetermined frequency. The electrodes 11*a*–11*d* are electrically paired, one electrode of a pair connected to a terminal of the oscillator circuit 20. The electrode connection to the circuit 20 is shown symbolically in FIG. 1. It is empirically determined that voltages of 300 volts or more are required.

The substrate 10 is immersed in a reservoir of liquid ink. The surface 15 and the electrodes 11*a*–11*d* are covered by a thin film 12 of the ink. The surface 15 is aligned in parallel with the ink surface 13. As the electrodes 11*a*–11*d* are excited by the oscillator 20, capillary wavelets are formed on the ink surface 13 of the reservoir.

The voltage on the electrodes 11*a*–11*d* creates electric fields in the liquid film 12. The electric field gradients create dielectric forces upon the ink. Microscopically the bipolar nature of water molecules, which form the liquid base ingredient, creates a force upon the molecules when a voltage is applied to the electrodes 11*a*–11*d*. The dipolar molecules are attracted toward the regions of highest field gradients (i.e., the edges of the electrodes), no matter what the polarity of the voltage applied to a given electrode.

Macroscopically the surface 13 of the liquid film 12 is disturbed and two series of inwardly and outwardly moving radial capillary waves 14A and 14B respectively are created. Being circular, the inwardly moving series of waves 14A is focused at the center 16 of the electrodes 11*a*–11*d*. These waves 14A meet at the center 16 and act to raise a mound on the liquid surface 13. With sufficient energy, ink droplets are ejected from the surface 13 at the center 16. The surface tension and the mass density of the ink determine the minimum threshold energy level for ejecting droplets from the surface 13.

Figure 3:
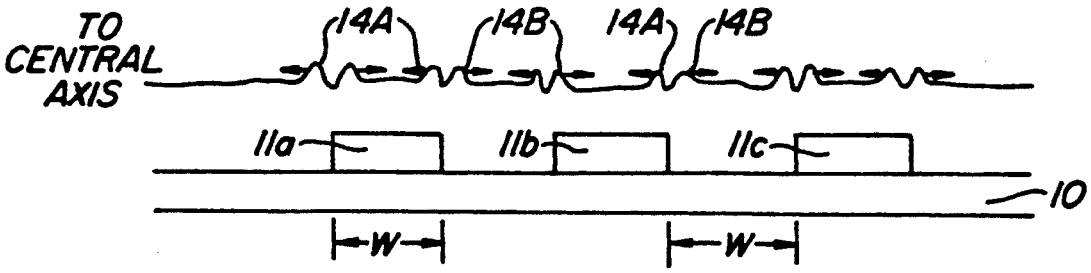
FIG. 3 is a detailed and enlarged side view of the wave droplet ejector according to the present invention.

FIG. 3 details the side view of FIG. 2. When the oscillator circuit 20 drives the electrodes 11*a*–11*d*, waves are periodically formed above the edges of the electrodes 11*a*–11*d* where the electric field gradients are the strongest. As shown in the drawing, each generated wave separates into two oppositely-moving waves 14A and 14B, one moving inward and the other moving outward. The electrodes 11*a*–11*d* are arranged on the substrate 10 such that as each inwardly moving wave 14A passes over an edge of an electrode 11*a*–11*d*, the electrodes 11*a*–11*d* are electrically driven again by the oscillator circuit 20. Thus, the waves 14A reinforce each other by superposition. The amplitude of the waves are built up as the waves 14A move toward the center 16. Each reinforced circular wave 14A converges at the center 16, and a mound is raised on the surface 13. When the energy of the converging waves 14A is sufficiently great, a droplet is ejected from the surface 13 along the axis 16.

The embodiment of the present invention shown in FIG. 3 has the width W of each electrode equal to the radial distance separating each electrode. The oscillator circuit 20 oscillates at a frequency $$f = V_{capillary}/2W$$

where $V_{capillary}$ is the velocity of the waves generated at the reservoir surface by the excited electrodes. The factor of 2 in the denominator of the fraction for the frequency f results from that the dielectric body forces are proportional to the gradient of the square of the electric field. Therefore, a sinusoidal oscillator which is represented by, say, a sin $\omega t$ function results in a dielectric body force proportional to $\sin^2 \omega t = (1-\cos 2\omega t)/2$, i.e., the driving term is at a frequency $2\omega$.

Stated differently, W is set approximately equal to the wavelength of the waves 14A. This relationship ensures that each wave 14A is built up as it passes over each edge of the electrodes along the way to the electrode center. In other words, each wave 14A is reinforced at the outside edge and inside edge of each of the electrodes 11*a*–11*d* over which the wave 14A passes.

The number of electrodes in the drawings have been selected for illustrative purposes. Depending upon the surface tension of the surface 15, the density and the viscosity of the liquid ink, the number of electrodes is optimized by balancing the increased energy imparted by a large number of electrodes against the dissipative effect of the distance over which the wavelets must travel. Beyond a certain point, additional electrode rings are of little effect since the capillary waves from the outermost rings are attenuated by the time they reach the center 16. The optimum number of electrode rings should cover a few capillary wave attenuation lengths for a particular operational frequency.

Another parameter to be considered is the film depth, i.e., the distance between the ink reservoir surface 15 and the top of the electrodes 11*a*–11*d*. For optimum effect, the film depth should be on the order of the spacing between the electrodes (W).

As an example, for water where the surface tension is 0.0727 Nt/m and the density is 1000 kg/m$^3$, an ejector according to the present invention can operate quite efficiently by setting the width W at 0.25 mm, the frequency f at 2700 Hz, a film depth of 0.25 mm and the number of concentric electrode pairs at 3 or 4.

The oscillator circuit 20 which drives the electrodes 11*a*–11*d* may be modulated so that ink droplets are ejected when required, as a recording medium, such as paper, is moved above the ink surface 15 with respect to the ejector. When a droplet is not needed, the oscillator 20 is off. When a droplet is required, the oscillator 20 agitates the surface 15 as described to eject the droplet.

Alternatively, the oscillator 20 may be operated continuously and the amplitude of the electrical signals modulated to eject droplets on demand.

An alternative embodiment of the ejector of the present invention is to replace the substrate 10 with a semiconductor substrate. Instead of the metal electrodes discussed above, the substrate is heavily doped with impurities to form circularly concentric conducting regions in the semiconductor substrate. Such doping techniques are well-known to those in the semiconductor service field. These conducting regions are connected to an oscillator circuit and operate in the same manner as the electrodes to create radial capillary waves.

While the above is a complete description of the preferred embodiments of the invention, various alternatives, modifications and equivalents may be used. It should be evident that the present invention is equally applicable by making appropriate modifications to the embodiments described above. Therefore, the above description should not be taken as limiting the scope of the invention which is defined by the appended claims.

What is claimed is:

1. An ejector for ejecting droplets from a liquid-filled reservoir, said ejector comprising a substrate having a generally planar surface, said substrate submerged in said reservoir so that said surface is parallel to a reservoir surface at a shallow predetermined depth;

concentric, circular, electrodes at said substrate surface around a center, said electrodes spaced apart by a predetermined distance and numbering more than two; and an oscillator circuit coupled to said electrodes for exciting said electrodes at a predetermined frequency, said predetermined frequency and said predetermined distance of said spaced electrodes related to each other such that capillary waves generated on said reservoir surface by said excited electrodes reinforce each other for the ejection of droplets from said reservoir at said center.

2. The ejector as in claim 1 wherein said electrodes are electrically paired, each one of said electrically paired electrodes is connected to one of two terminals of said oscillator circuit.

3. The ejector as in claim 1 wherein said electrodes are separated from each other by a predetermined distance and said electrodes have a predetermined width.

4. The ejector as in claim 3 wherein said capillary waves on said reservoir surface attenuate over a predetermined distance for a particular operational frequency of said oscillator circuit, said electrodes numbering such that said electrodes are spaced over a few multiples of said predetermined distance.

5. The ejector as in claim 3 wherein said predetermined distance and width are equal.

6. The ejector as in claim 5 wherein said oscillator circuit operates at a frequency f $$f = V_{capillary}/2W$$

where $V_{capillary}$ is a velocity of said capillary waves and W is said predetermined distance.

7. The ejector as in claim 1 wherein said electrodes have a predetermined spacing between said electrodes, and said predetermined depth has same order of magnitude as said spacing.

8. The ejectors as in claim 1 wherein said substrate comprises a non-conducting material and said electrodes comprises conducting material.

9. The ejector as in claim 8 wherein said substrate comprises glass.

10. The ejector as in claim 8 wherein said substrate comprises plastic.

11. The ejector as in claim 1 wherein said substrate comprises semiconductor material and said electrodes comprise regions heavily doped with impurities at said substrate surface.

* * * * *